United States Patent [19]

Powell

[11] Patent Number: 4,989,916

[45] Date of Patent: Feb. 5, 1991

[54] UPHOLSTERED ARTICLE OF FURNITURE

[76] Inventor: James A. Powell, Graystones, Westfield Road, Leeds, England

[21] Appl. No.: 469,532

[22] PCT Filed: Jul. 14, 1988

[86] PCT No.: PCT/GB88/00567

§ 371 Date: Mar. 15, 1990

§ 102(e) Date: Mar. 15, 1990

[87] PCT Pub. No.: WO89/00391

PCT Pub. Date: Jan. 26, 1989

[30] Foreign Application Priority Data

Jul. 15, 1987 [GB] United Kingdom ..... 8716681

[51] Int. Cl.[5] ..... A47C 16/00

[52] U.S. Cl. ..... 297/439; 297/462; 52/DIG. 9; 248/575

[58] Field of Search ..... 297/439, 452, 461, 462; 248/575, 161, 157; 52/309.15, , 309.8, DIG. 9

[56] References Cited

U.S. PATENT DOCUMENTS

| | | | |
|---|---|---|---|
| 2,612,942 | 10/1952 | Simjian | 297/462 X |
| 3,125,377 | 3/1964 | Bridges | 297/462 X |
| 3,848,853 | 11/1974 | Way et al. | 52/DIG. 9 |
| 3,951,384 | 4/1976 | Hildreth, Jr. | 52/DIG. 9 X |
| 4,099,771 | 7/1978 | Mathews | 297/217 |
| 4,785,577 | 11/1988 | Lederbauer | 52/DIG. 9 |

*Primary Examiner*—Peter A. Aschenbrenner

*Attorney, Agent, or Firm*—Merchant, Gould, Smith, Edell, Welter & Schmidt

[57] ABSTRACT

There is disclosed an upholstered article of furniture in the form of a pouffe (10) which comprises a base (11), a single scrap rubber tire, or a stack of rubber tires, mounted generally horizontally on the base, upholstery (13), and padding (14) arranged at predetermined locations between the tire and the upholstery.

6 Claims, 1 Drawing Sheet

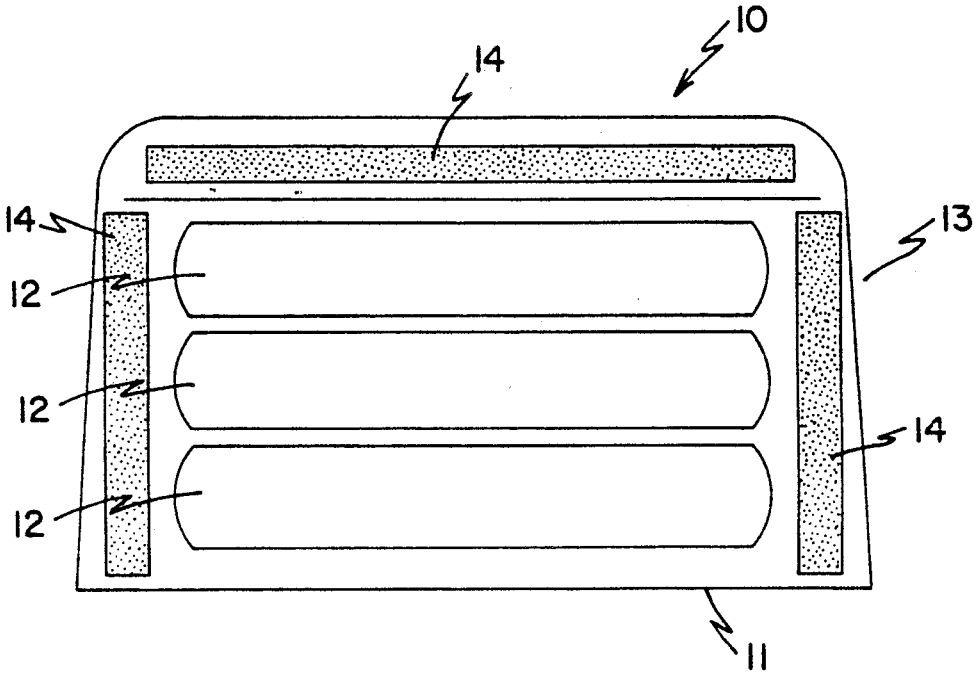
10
14
14
13
12
12
14
12
11

UPHOLSTERED ARTICLE OF FURNITURE

This invention relates to an upholstered article of furniture.

The invention has been developed primarily, though not exclusively, with a view to provide a commerical outlet for scrap tires used on road vehicles, and especially worn tires used on motor cars.

The disposal of worn tires is a major problem, as can be evidenced by the large stock piles of worn tires which can be seen in scrap yards around the country. The tire manufacturers have no need for worn tires, as the product is not one which can readily be recycled at economic cost. There is a demand for the ground-down rubber dust which can be buffed-off from whatever remains of the "tread" of a worn tire, but this only comprises up to one third of the overall weight of the tire, and there still remains the bulk of the tire for which there is little or not economic value, but which presents a substantial disposal problem.

Therefore, there would be evident substantial environmental and economic advantages to be derived if a useful commerical outlet could be found for worn vehicle tires.

To this end, the present invention provides an economic and technically viable use for worn tires in upholstered articles of furniture, in which the properties of resilience which are inherent in a tire (even when worn) are used as a substitute for metal springs and/or plastics foam presently used in upholstered furniture, such as armchairs and sofas.

According to the invention there is provided an upholstered article of furniture which comprises a base, a tire mounted generally horizontally on the base, upholstery, and padding arranged at predetermined locations between the tire and the upholstery.

The padding will be arranged at any required locations in order to impart a satisfactory surface appearance to the upholstery, as well as making the article fit for the particular function which it is intended to carry out.

When the article of furniture includes a generally horizontal seat or support portion, the padding will be such as to cushion the load applied and to provide an acceptable "feel", so that the effect of the tire is cushioned. However, the tire itself, which is arranged generally horizontally i.e. with its axis of rotation extending substantially vertically, imparts rigidity and stability to the article, but also has a certain degree of resilience so as to simulate the type of response to an applied load which would be provided by conventional springs, or foamed plastics, in existing articles of furniture i.e. it functions rather as a rubber spring.

It will be particularly economical for the tire to be obtained from a supply of scrap tires, but in order to reduce the weight of the tire, and also to derive a commercial return for the only portion of a scrap tire of any appreciable value, it will be preferable for the tread of the tire to be buffed-off to produce rubber dust, and therefore the tire as supplied to the furniture manufacturer will be a substantially smooth (untreaded) tire.

In one preferred construction according to the invention, the article of furniture comprises a "pouffe" i.e. a backless seat or footrest, in which a plurality of tires are stacked one upon the other, and preferably with adhesive bonding between the interengaging sufaces of the tires. Horizontal padding may then be applied above the uppermost tire of the stack, and also generally vertical padding may be arranged around the stack e.g. in a circular band.

A circular cross-section pouffe can therefore be obtained, which is stable, robust, has necessary yielding properties in a vertical sense, and has a satisfactory "feel" and appearance by virtue of the padding.

The padding may take any form which is employed in conventional upholstered furniture, such as polyurethane foam. However, it is particularly preferred that non-inflammable, or at least non-toxic (upon combustion) components should be inncorporated in the construction of the article of furniture, in which case the use of tires is advantageous over known plastics foams, some of which give-off lethal cyanide gaseous fumes upon combustion.

While it is true that ties burn, when sufficient heat is applied to them, a tire exposed to a typical fire risk of an article of furniture, namely a smouldering cigarette end, will not burn or even smoulder. It is therefore believed that upholstered article of furniture can be manufactured, incorporating one or more tire, preferably a scrap tire, which will be able to meet fire standards and regulations.

While a pouffe has been described above as one example of an article of furniture to which the invention may be applied, it should be understood that the invention is applicable to other types of upholstered furniture having a generally horizontal seating or supporting surface, such as an armchair, sofa, or a bed.

One embodiment of upholstered article of furniture according to the invention will now be described in detail, by way of example only, with reference to the accompanying schematic drawing.

Referring now to the drawing, this is a schematic view in vertical cross-section of an upholstered article of furniture according to the invention, in the form of a circular cross-section pouffe. The pouffe is designated generally by reference 10, and comprises a base 11, which may be a sheet of wood or metal, and a stack of tires 12 mounted on the base 11, each tire 12 extending generally horizontally in the normal attitude of use of the pouffe. Upholstery fabric 13 (preferably flame retardant calico) is applied over and around the stack of tires, and padding 14 is arranged at predetermined locations between the tires 12 and the upholstery fabric 13.

The padding 14 is arranged at any required locations in order to impart a satisfactory appearance to the upholstery, as well as making the article fit for the particular function which it is intended to carry out.

The tires 12 in the stack are preferably adhesively bonded to each other by any suitable adhesive, between interengaging surfaces.

The padding 14 will be made of any conventional material employed in upholstered furniture, and should be of such a constitution as to cushion the load applied and to provide an acceptable "feel", so that the effect of the tires is cushioned.

the stack of tires impart rigidity and stability to the article as a whole, but they have a certain degree of resilience so as to simulate the type of respose to an applied load which would be provided by conventional springs, or foamed plastics in existing articles of furniture.

The tires 12 are preferably obtained from a supply of scrap tires, and usualy the "tread" of the tires will be removed by buffing-off, to produce rubber dust which has a commercial value. This will also reduce the weight of the tires.

While there has been described above the application of the invention to an article of furniture in the form of a pouffe i.e. a backless seat or footrest, in which a plurality of tires are stacked one upon the other, the invention is also applicable to other articles of upholstered furniture, such as armchairs, sofas and beds, though in these cases it will often be sufficient for only a single tire, or single layer of tires to be provided.

I claim:

1. An upholstered article of furniture which comprises a base (11), a tire (12) mounted generally horizontally on the base, upholstery (13), and padding (14) arranged at predetermined locations between the tire and the upholstery.

2. An article of furniture according to claim 1, in which the tire is a scrap or worn tire.

3. An article of furniture according to claim 2, in which the scrap or worn tire has its tread removed.

4. An article of furniture according to claim 1, in which a stack of tires (12) is arranged on the base (11).

5. An article of furniture according to claim 4, in which the tires are bonded to each other in the stack.

6. An article of furniture according to claim 1 and in the form of a furniture pouffe (10), and including horizontal padding (14) arranged above the tire(s) and upright padding (14) arranged between the radially outer side of the tire(s) and the upholstery.

* * * * *